United States Patent [19]

Minkevitch et al.

[11] Patent Number: 4,723,691

[45] Date of Patent: Feb. 9, 1988

[54] POWDER DISPENSER

[76] Inventors: Joseph M. Minkevitch, 26 Folan Ave., Norwood, Mass. 02062; Edward J. Martin, 107 Washington Green, East Walpole, Mass. 02032

[21] Appl. No.: 897,623

[22] Filed: Aug. 15, 1986

[51] Int. Cl.[4] ..... B65D 37/00

[52] U.S. Cl. ..... 222/210; 239/327; 169/30

[58] Field of Search ..... 169/30, 33, 35; 222/206, 212, 215, 210; 239/327–328

[56] References Cited

U.S. PATENT DOCUMENTS

| | | | |
|---|---|---|---|
| 2,551,676 | 5/1951 | Hoffman | 222/215 X |
| 2,731,093 | 1/1956 | Gordon | 222/215 X |
| 3,213,902 | 10/1965 | Mote | 222/215 X |
| 4,044,836 | 8/1977 | Martin et al. | 169/30 |

*Primary Examiner*—F. J. Bartuska
*Assistant Examiner*—Michael S. Huppert
*Attorney, Agent, or Firm*—Joseph S. Iandiorio; Douglas E. Denninger

[57] ABSTRACT

Hand-held and hand-operable powder dispenser having a container including a handle/nozzle section terminating at its discharge end in an unobstructed powder dipensing opening, a hand gripping section, and a central, flexible bellows section coupled between the handle/nozzle section and the hand-gripping section. The bellows section is adapted to be collapsed and expanded axially to serve as a pump. The inside diameters of the handle/nozzle section decrease substantially linearly and continually as a function of the length of the handle/nozzle section in a direction toward the powder dispensing opening. The ratio of the length of the handle/nozzle section to the greatest value of its inside diameter is substantially greater than 1.4.

9 Claims, 1 Drawing Figure

POWDER DISPENSER

FIELD OF INVENTION

Figure 1:
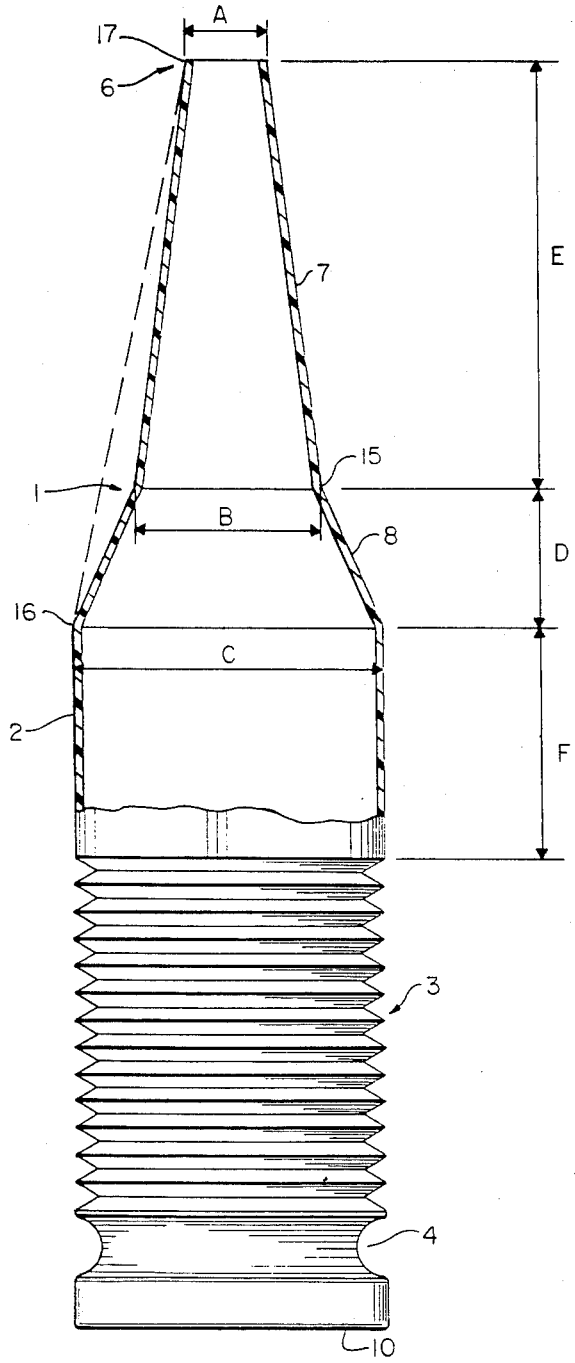

This invention relates to the field of powder dispensers and more particularly to hand-held dispensers particularly suitable to be employed a fire extinguishers.

BACKGROUND OF INVENTION

U.S. Pat. No. 4,044,836, issued to the inventors on Aug. 30, 1977. This patent, incorporated by reference herein, relates to a dry powder; hand-held operated fire extinguisher, preferably made of plastic, and capable of being easily manually pumped by the user by axial to-and-fro movements, to discharge powder in a predetermined area. The pumping action permits the intake of a sufficient quantity of air to create cloudlike bursts of powder directed, for example, upon a grease fire in a kitchen. Typically, the powder dispenser of the above mentioned patent, is filled about half way with the powder to be dispensed, such as monoammonium phosphate or siliconized dry chemical powder (sodium bicarbonate), well known to those versed in the fire extinguishing art. As mentioned in the aforesaid patent, the monoammonium phosphate powder was capable of extinguishing a class 1B fire as defined by the Underwriters Laboratories U.L. 711 Standard for Safety, relating to fire extinguishers. While the embodiment of the invention of FIG. 6 of the aforesaid patent, did extinguish Class 1B fires, it was not capable of initially discharging up to 10 feet of powder as required by the U.L. 299 Standard for consistingly extinguishing Class 2B pan fires. To successfully meet the U.L. standards for dry chemical fire extinguishers weighing under 5 lbs for extinguishing a Class 2B fire, it is necessary to provide an extinguisher which can extinguish a 5 square foot pan fire filled with heptane gasoline. While the embodiment of FIG. 6 of the aforesaid patent was capable of producing an effective average "throw distance" of about six feet, it was found that such a throw distance was insufficient, as required by U.L. Laboratories. U.L. established that a "throw distance" of ten feet is required. The requirement of consistently extinguishing a five square foot kitchen fire is especially important, since grease is often involved, which tends to splatter, particularly if a liquid is applied to the fire by a homeowner. Since the issuance of the aforesaid patent in 1977, the inventors struggled over a period of several years to find a dry powder dispenser configuration which was able to consistingly produce a "throw distance" of ten feet, in order to meet the above stated U.L. standards for a class 1B and 2B fire. At least two thousand man hours was dedicated to this task, involving experimenting with various types of nozzle configurations, tested under various conditions such as, for example, with and without wind; indoors and outdoors; and upon various types of fires such as grease, gasoline, and trash fires. Surprisingly, it was discovered that small changes in the dimensions of our prior extinguishers made a substantial difference in the results.

SUMMARY OF INVENTION

It is an object of this invention to provide an improved dry powder dispenser capable of enhanced performance relative to dispensers made in accordance with the prior art.

It is a further object of the invention to provide a dry powder fire extinguisher having a consistently increased "throw distance", enabling the user to consistently extinguish fires of greater size, and with less danger to the user, as the user need not be as close to the fire as was previously the case.

It is a further of the invention to provide an improved dry powder hand-operated fire extinguisher which is small, inexpensive, easy to manufacture and use, and yet is capable of meeting the Underwriters Laboratory requirements for 2B fires.

It is yet a further object of the invention to provide a simple, inexpensive dry powder fire extinguisher for the use of untrained fire fighters, enabling them to consistently extinguish larger skillet grease fires, household wastebasket fires, and automobile engine fires.

The invention features an improved hand-held and hand-operable powder dispenser and method, including a handle/nozzle section terminating at its discharge end in an unobstructed powder dispensing opening, a hand gripping section; a flexible bellows section coupled between the handle/nozzle section and the hand gripping section, such bellows section being adapted to be collapsed and expanded axially to serve as a pump, and wherein the inside diameters of the handle/nozzle section decrease substantially linearly as a function of the length of such section in a direction toward the powder dispensing opening, and wherein the ratio of the length of the handle/nozzle section to the greatest value of the inside diameter thereof, is substantially greater than one.

In a preferred embodiment, this ratio is about one and eight tenths, the inside nozzle diameter at the discharge end of the handle/nozzle section is about 0.62 inches, and the length of the handle/nozzle section is about 5.37 inches.

DISCLOSURE OF PREFERRED EMBODIMENT

Hand-held and hand-operable powder dispenser having a container including a handle/nozzle section terminating at its discharge end in an unobstructed powder dispensing opening, a hand gripping section, and a central, flexible bellows section coupled between the handle/nozzle section and the hand-gripping section. The bellows section is adapted to be collapsed and expanded axially to serve as a pump. The inside diameter of the handle/nozzle section decrease substantially linearly and continually as a function of the length of the handle/nozzle section in a direction toward the powder dispensing opening. The ratio of the length of the handle/nozzle section to the greatest value of its inside diameter is substantially greater than 1.4.

The improved hand-held and hand-operated powder dispenser, illustrated in the accompanying figure, FIG. 1, has a handle/nozzle section 1 mechanically coupled by means of a cylindrical band section 2 to a thin walled flexible bellows section 3, the lower portion thereof in turn being affixed to a hand-gripping section 4. A right-handed user, would grip handle/nozzle section 1 with his or her left hand, and grip hand gripping section 4 with the right hand. As explained in the aforesaid patent, the container would be half filled with a powder suitable for extinguishing fires, and the operator would aim the extinguisher at the fire so that typically, nozzle 6 would be closest to the fire, and hand gripping section 4 would often be somewhat elevated with respect to the nozzle 6, in order to direct the powder toward, for example, a kitchen pan fire.

The handle/nozzle portion of the improved design of this invention preferably has a first truncated conical section 7 and a second truncated conical section 8, as illustated in the Figure. Referring back to FIGS. 5 and 6 of our aforesaid patent, it may be observed that the inside diameter of the handle/nozzle sections decrease non-linearly along the length of the sections toward the nozzle discharge orifice. In contrast, each section 7 and 8 of the figures, making up the handle/nozzle portion, has an inside diameter which decreases linearly along the length of the extinguisher in a direction toward nozzle 6. Surprisingly, this small difference is apparently partially responsible for the dramatically increased throw distance discussed above.

Our extensive experimentation culminated in the most preferred extinguisher shown in the figure, having the following dimensions: the distance E between the end of nozzle 6 and the termination of handle/nozzle section 7 at portion 15 was $4\frac{1}{8}$ inches. Dimension D, namely the length of the second handle/nozzle section 8 was $1\frac{1}{4}$ inches; the inside diameter B of the extinguisher at the boundary of section 7 and 8 was $1\frac{3}{4}$ inches, whereas dimension C, representative of the largest inside diameter of the handle/nozzle section was 3 inches. Dimension F, namely the length of the cylindrical band section was $2\frac{1}{8}$ inches and the overall length of the extinguisher between the nozzle 6 and the base 10 was $12\frac{1}{8}$ inch.

It is believed that the previously described enhanced results of this invention may also be obtained by providing a single handle nozzle section rather than two discrete sections 7 and 8 as illustrated. The inside wall of such a section would have an inside wall corresponding to the dashed line, between portion 16 at the lower edge of section 8 and portion 17 at the edge of nozzle 6. It is believed that such an elongated conical handle/nozzle structure would also produce enhanced results with respect to the prior embodiments of the previous patent. Thus an important feature of this invention, is to provide a handle/nozzle section wherein the inside diameters thereof decrease substantially linearly as a function of the length of the handle/nozzle in a direction toward nozzle 6. It is however an important additional qualification, that the ratio of the length of the handle/nozzle section to the greatest value of the inside diameter of the handle/nozzle section is substantially greater than unity. This is in contrast to the embodiment of FIG. 3 of our prior patent set forth above. This ratio is about 1.8 in the preferred embodiment, derived from dividing the sum of dimensions D plus E by dimension C.

Surprisingly, we have found that the maximum "throw distance" of dry powder is obtained by having the inside diameter of nozzle 6 (dimension A in the figure) equal $\frac{5}{8}$ of an inch. If however, the inside diameter of nozzle 6 is further increased to $\frac{3}{4}$ of an inch, operating problems will occur. When the operator points the extinguisher in a somewhat downward direction upon, for example, a kitchen pan fire, an inside diameter of $\frac{3}{4}$ of an inch results in an increased discharge of the powder out of the extinguisher, but not directly at the fire. This effect represents a waste of the powder, and of course is highly undesirable.

Accordingly, although the complex fluid mechanics involved in the ejection of the turbulent dry powder is not fully understood, we have determined empirically that the above described specific embodiment having discrete sections 7 and 8, dramatically increases the "throw distance" to effectively, for the first time, enable a hand held, inexpensive plastic fire extinguisher to be utilized to extinguish a five square foot kitchen grease fire. Thus the homeowner need no longer be concerned with whether the conventional steel fire extinguisher has adequate gas pressure therein to render it reliable. In addition this invention removes the disadvantage of having to use liquids to extinguish grease fires: liquids cause splattering of the grease and often fail to extinguish the fire.

Other embodiments will occur to those skilled in the art and are within the following claims:

What is claimed is:

1. In a hand-held and hand-operable powder dispenser having a container including a handle/nozzle section terminating at its dischage end in an unobstructed powder dispensing opening, a hand gripping section; a central, flexible bellows section coupled between said handle/nozzle section and said hand gripping section, said bellows section being adapted to be collapsed and expanded axially to serve as a pump; said handle/nozzle section fitting one hand of an operator while said operator grasps said hand gripping section with the other hand to axially pump said central bellows section for dispensing dry powder contained therein in repeated cloud-like bursts; the improvement wherein the inside diameters of said handle/nozzle section decrease substantially linearly and continually as a function of the length of said handle/nozzle section in a direction toward said powder dispensing opening, and wherein the ratio of the length of said handle/nozzle section to the greatest value of the inside diameter thereof, is substantially greater than 1.4.

2. The powder dispenser of claim 1 wherein the length of said handle/nozzle section is about $5\frac{3}{8}$ inches.

3. The powder dispenser of claim 1 wherein the greatest inside diameter of said handle/nozzle section is about 3 inches.

4. The powder dispenser of claim 1 wherein the inside diameter of said powder dispensing opening is about 0.62 inches.

5. The powder dispenser of claim 1 wherein said inside diameters of said handle/nozzle section decrease continually, first at a steeper rate and then at a more shallow rate, as a function of the length of said handle/nozzle section in a direction toward said powder dispensing opening.

6. In a hand-held and hand-operable powder dispenser having a container including a handle/nozzle section terminating at its discharge and in an unobstructed powder dispensing opening, a hand gripping section, a central, flexible bellows section coupled between said handle/nozzle section and said hand gripping section, said bellows section being adapted to be collapsed and expanded axially to serve as a pump; said handle/nozzle section fitting one hand of an operator while said operator grasps said hand gripping section with the other hand to axially pump said central bellows section for dispensing dry powder contained therein in repeated cloud-like bursts; the improvement wherein the inside diameters of said handle/nozzle section decrease substantially linearly and continually, first at a steeper rate and then at a more shallow rate, as a function of the length of said handle/nozzle section in a direction toward said powder dispensing opening, and wherein the ratio of the length of said handle/nozzle section to the greatest value of the inside diameter thereof, is about 1.8.

7. The powder dispenser of claim 6 wherein the length of said handle/nozzle section is about 5⅜ inches.

8. The powder dispenser of claim 6 wherein the greatest inside diameter of said handle/nozzle section is about 3 inches.

9. The powder dispenser of claim 6 wherein the inside diameter of said powder dispensing opening is about 0.62 inches.

* * * * *